US009481184B2

(12) United States Patent
Ohnishi

(10) Patent No.: US 9,481,184 B2
(45) Date of Patent: Nov. 1, 2016

(54) TRANSFER PRINTING METHOD AND APPARATUS

(71) Applicant: MIMAKI ENGINEERING CO., LTD, Tomi (JP)

(72) Inventor: Masaru Ohnishi, Tomi (JP)

(73) Assignee: MIMAKI ENGINEERING CO., LTD., Tomi (JP)

( * ) Notice: Subject to any disclaimer, the term of this patent is extended or adjusted under 35 U.S.C. 154(b) by 0 days.

(21) Appl. No.: 14/241,448

(22) PCT Filed: Sep. 28, 2012

(86) PCT No.: PCT/JP2012/075213
§ 371 (c)(1),
(2) Date: Feb. 27, 2014

(87) PCT Pub. No.: WO2013/047818
PCT Pub. Date: Apr. 4, 2013

(65) Prior Publication Data

US 2014/0204145 A1 Jul. 24, 2014

(30) Foreign Application Priority Data

Sep. 29, 2011 (JP) ..... 2011-215461

(51) Int. Cl.
*B41J 11/00* (2006.01)
*B44C 1/17* (2006.01)
(Continued)

(52) U.S. Cl.
CPC ..... *B41J 11/0015* (2013.01); *B41J 2/0057* (2013.01); *B41J 2/01* (2013.01); *B41J 11/002* (2013.01); *B41M 5/0256* (2013.01); *B41M 5/03* (2013.01); *B44C 1/17* (2013.01); *B41J 2002/012* (2013.01)

(58) Field of Classification Search
CPC ..... B41J 11/0015
USPC ..... 347/16, 102; 524/236; 427/428.06; 106/203.1; 523/160
See application file for complete search history.

(56) References Cited

U.S. PATENT DOCUMENTS 5,425,806 A * 6/1995 Doolan et al. ..... 106/203.1
2006/0014868 A1* 1/2006 Mae et al. ..... 524/236
(Continued)

FOREIGN PATENT DOCUMENTS

CN 101747681 A 6/2010
EP 1184197 A 3/2002
(Continued)

OTHER PUBLICATIONS

International Search Report in International Application No. PCT/JP2012/075213, dated Nov. 6, 2012.
(Continued)

*Primary Examiner* — Lisa M Solomon
(74) *Attorney, Agent, or Firm* — Park, Kim & Suh, LLC

(57) ABSTRACT

A printing method is provided that enables a high-quality transfer image to be obtained with simple steps. As a solution, a printing method according to the present invention includes an applying step of applying a latex ink onto a transfer medium 10 to form an ink applied surface, a heating step of heating the transfer medium 10 to increase the viscosity of the latex ink, a transfer step of contacting and transferring the latex ink on the transfer medium 10 to a printing target 15, and a drying step of drying the latex ink on the printing target 15.

17 Claims, 4 Drawing Sheets

(51) Int. Cl.

| | |
|---|---|
| ***B41M 5/025*** | (2006.01) |
| ***B41M 5/03*** | (2006.01) |
| ***B41J 2/005*** | (2006.01) |
| ***B41J 2/01*** | (2006.01) |

(56) References Cited

U.S. PATENT DOCUMENTS

| | | | | |
|---|---|---|---|---|
| 2006/0128830 | A1* | 6/2006 | Breton | C09D 11/30 523/160 |
| 2007/0211128 | A1* | 9/2007 | Parker et al. | 347/103 |
| 2012/0098882 | A1* | 4/2012 | Onishi | B41J 29/377 347/18 |

FOREIGN PATENT DOCUMENTS

| | | | | |
|---|---|---|---|---|
| EP | 2546058 | A1 | | 1/2013 |
| JP | 6-8697 | A | | 1/1994 |
| JP | 06008697 | | * | 1/1994 |
| JP | 2006-130725 | A | | 5/2006 |
| JP | 2007-331794 | A | | 12/2007 |
| JP | 2007331794 | | * | 12/2007 |
| JP | 2009-214439 | A | | 9/2009 |
| JP | 2009-226852 | A | | 10/2009 |
| JP | 2010-143073 | A | | 7/2010 |
| JP | 2010143073 | | * | 7/2010 |
| JP | 2011-140133 | A | | 7/2011 |
| WO | 2011/111689 | A1 | | 9/2011 |

OTHER PUBLICATIONS

Korean Office Action in Appln. No. 10-2014-7005285 dated Apr. 21, 2015 with English translation.

Chinese Office Action in Appln. No. 201280048321.8 dated Sep. 29, 2014 with English translation.

European Search Report in Appln. No. 12836132.6 dated Feb. 16, 2015.

European Communication in Appln. No. 12836132.6 dated Sep. 30, 2015.

Japanese Office Action in Appln. No. 2011-215461 dated May 15, 2015 with English translation.

Japanese Final Office Action in Appln. No. 2011-215461 dated Aug. 20, 2015 with English translation.

Korean Final Rejection in Appln. No. 10-2014-7005285 dated Oct. 30, 2015 with English translation.

Korean Final Rejection in Appln. No. 10-2014-7005285 dated Feb. 25, 2016 with English translation.

* cited by examiner

TRANSFER PRINTING METHOD AND APPARATUS

CROSS-REFERENCE TO RELATED APPLICATIONS

This application is the National Stage filing under 35 U.S.C. 371 of International Application No. PCT/JP2012/075213, filed on Sep. 28, 2012, which claims the benefit of Japanese Patent Application No. 2011-215461, filed on Sep. 29, 2011, the contents of which are all hereby incorporated by reference herein in their entirety.

TECHNICAL FIELD

The present invention relates to a printing method and an inkjet ejecting apparatus, specifically a transfer printing method, and an inkjet ejecting apparatus used for the transfer printing method.

BACKGROUND ART

A transfer printing method is a method of directly printing pictures, characters, and the like on surfaces of various products, whereby a printed picture on a surface of a medium such as a film sheet is transferred to a product surface.

A known example of a conventional transfer printing method includes a first step of printing a UV ink image on a flat original sheet by using inkjet printing with a UV ink, a second step of irradiating the UV ink image with UV or an electron beam to bring the UV ink image to a semi-dry state while the UV ink image is being printed or immediately after the UV ink image is printed, a third step of transferring the semi-dry UV ink image to an elastic blanket surface, a fourth step of offset printing the transferred UV ink image from the elastic blanket to a printing object, and a step of drying and fixing the UV ink image formed by the offset printing (see PTL 1).

CITATION LIST

Patent Literature

PTL 1: JP-A-2006-130725

SUMMARY OF INVENTION

Technical Problem

However, intensive studies by the present inventor found that the portion printed first is exposed to more UV light than the subsequently printed portions when the technique described in PTL 1 is used in the multi-pass mode. Accordingly, the extent of curing differs for each pass of the printed UV ink, and the ink transfer characteristics vary greatly. The result is that a stable, high-quality printing result cannot be obtained.

Further, the technique described in PTL 1 requires two transfer steps, from the original sheet to the elastic blanket, and to a printing medium. Aside from requiring more than one transfer step, the need to clean the sheet after each transfer adds complexity to the process.

The present invention has been made in view of the foregoing problems, and it is an object of the present invention to provide a printing method that enables a high-quality transfer image to be obtained with simple steps.

Solution to Problem

In an embodiment of the present invention, the foregoing problems are solved by the means disclosed below.

Disclosed is a printing method that includes:

an applying step of applying a latex ink onto a transfer medium to form an ink applied surface;

a heating step of heating the transfer medium to increase the viscosity of the latex ink;

a transfer step of contacting and transferring the latex ink on the transfer medium to a printing target; and a drying step of drying the latex ink on the printing target.

By using the latex ink, a transfer image can be formed on the transfer medium without forming an ink receptive layer on the transfer medium. The transfer step thus requires only a single transfer from the transfer medium to the printing target, and can be simplified. Further, because the latex ink is used to form an image on the transfer medium, there will be no variation in the extent of curing as might occur with a UV ink, and a high-quality transfer image can be formed that does not involve ink bleeding. Further, the transfer image can transfer from the transfer medium to the printing target with the maintained desirable transfer performance in the semi-dry state.

It is preferable in the present invention that the latex ink have thermoplasticity in the state after the heating step, and that the transfer step contact and transfer the latex ink on the transfer medium to the printing target while heating the transfer medium. In this way, by transferring the latex ink while heating the transfer medium, specifically the latex ink on the transfer medium, stable transfer performance can be obtained.

It is preferable in the present invention that the applying step and the heating step be simultaneously performed by applying the latex ink onto the transfer medium while heating the transfer medium. In this way, because the transfer medium is heated, the latex ink is immediately heated upon landing, and thickens as the solvent and the water content evaporate. The ink can thus semi-dry before the landed ink has time to bleed.

It is preferable in the present invention that the latex ink have a viscosity of 100 mPa·sec to 200,000 mPa·sec at 25° C. after being thickened in the heating step. In this way, by increasing the latex ink viscosity to this range, the latex ink does not bleed during the transfer, and a high-quality image can be obtained. Further, because the ink is semi-dried, desirable transfer performance can be obtained.

It is preferable in the present invention that, in the transfer step, the transfer medium disposed to face the ink applied surface toward the printing target be pressed with a pressing member from the opposite side from the ink applied surface to contact the ink applied surface to the printing target, and transfer the latex ink on the transfer medium to the printing target. In this way, by pressing the transfer medium against the printing target with the pressing member from the opposite side of the latex ink applied surface of the transfer medium, the transfer medium can deform along the printing target, and contact the printing target to form a desirable transfer image even when the printing target is three-dimensional.

It is preferable in the present invention that the transfer step use a housing adaptable to install the transfer medium as a portion of its outer wall, or on the inner side of a portion of the housing outer wall, the outer wall portion of the housing being deformable or movable in response to inner volume changes, and the housing being capable of maintaining airtightness with the transfer medium installed therein, and that the transfer step include:

housing the printing target inside the housing;

installing the transfer medium as a portion of the housing outer wall, or on the inner side of a portion of the housing outer wall with the ink applied surface facing the printing target; and reducing the pressure inside the housing to deform or move the outer wall portion inwardly into the housing in a manner that lowers the inner volume of the housing, and to contact the ink applied surface of the transfer medium to the printing target, and transfer the latex ink on the transfer medium to the printing target. In this way, as with the case of applying pressure with the pressing member, the transfer medium can deform along the printing target, and contact the printing target to transfer the image on the transfer medium to the printing target even when the printing target is three-dimensional. In contrast to the pad press that can transfer the ink to only some parts of the printing target, the evacuation of the housing enables a transfer to the whole part of the printing target.

Also disclosed is an inkjet ejecting apparatus for use in the printing method. The inkjet ejecting apparatus includes an inkjet head that expels the latex ink onto the transfer medium in the form of an inkjet droplet; a heater that heats the transfer medium; and a controller that controls the temperature of the heater. The inkjet printing by expulsion of the latex ink in the form of an inkjet droplet makes it possible to form the ink applied surface at high speed; specifically, time can be saved for the applying step. Further, by controlling the heater temperature, the latex ink can be brought to the desired cure state (temporary cure state or permanent cure state).

Advantageous Effects of Invention

With the printing method disclosed, a high-quality transfer image can be obtained with simple steps.

DESCRIPTION OF EMBODIMENTS

Figure 1:
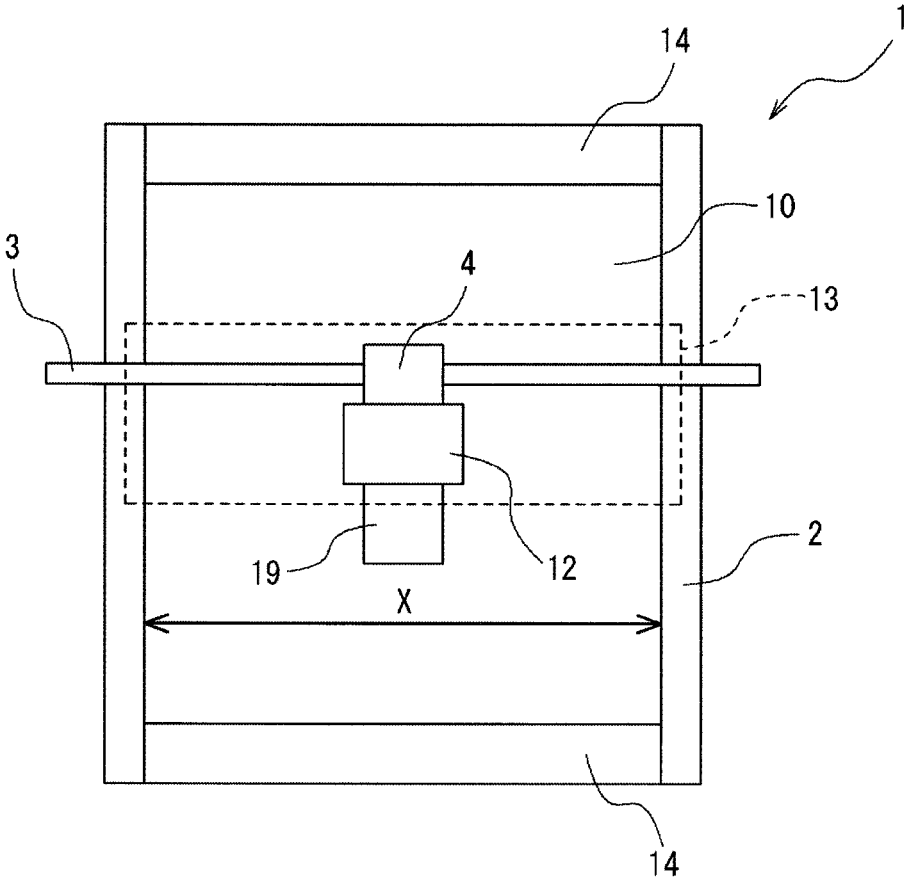
FIG. 1 is a plan view (schematic diagram) representing an exemplary inkjet ejecting apparatus according to an embodiment of the present invention.

Embodiments of the present invention are described below in detail with reference to the accompanying drawings. In the appended figures referred to in the descriptions of the embodiments, members with the same functions may have the same reference numeral, and explanations thereof may be omitted to avoid redundancy.

A printing method according to the present embodiment includes:

an applying step of applying a latex ink onto a transfer medium in a pattern to be transferred (in a region to be transferred) to form an ink applied surface (surface with the applied ink);

a heating step of heating the transfer medium to increase the viscosity of the latex ink;

a transfer step of contacting and transferring the latex ink on the transfer medium to a printing target; and a drying step of drying the latex ink on the printing target.

The ink used in the present embodiment is an emulsion or suspension ink (hereinafter, collectively referred to as "latex ink") prepared by dispersing a thermoplastic resin in water and a solvent with an optionally added color material. Additives such as surfactants, sizing agents, and preservatives also may be added, as required.

More specifically, examples of the latex ink include an acryl emulsion latex, a urethane emulsion latex, and an SBR (Styrene Butadiene Rubber) latex. Examples of the color material include dyes, pigments, and fine particles suspended or dissolved in water or solvent.

Examples of the solvent include organic solvents that contain a glycol ether as a main component. Specific examples of the glycol ether include monobutyl ethers such as diethylene glycol or triethylene glycol; monobutyl ethers, monoethyl ethers, monopropyl ethers, or monomethyl ethers of propylene glycol; monobutyl ethers of dipropylene glycol; ethers such as monohexyl ethers of diethylene glycol, and mixtures thereof. The glycol ether is preferably at least one selected from diethylene glycol diethyl ether, dipropylene glycol monomethyl ether, and triethylene glycol monomethyl ether.

These may be used with other organic solvents, as required. Examples of such other organic solvents include esters (such as ethylene glycol monomethyl ether acetate, ethylene glycol-monoethylether acetate, diethylene glycol monomethyl ether acetate, and propylene glycol monomethyl ether acetate), and lactone solvents. The lactone solvents are compounds having a cyclic structure with an ester bond, for example, such as γ-lactone with a five-membered ring structure, δ-lactone with a six-membered ring structure, and ϵ-lactone with a seven-membered ring structure. For example, γ-butyrolactone, γ-valerolactone, γ-hexalactone, γ-heptalactone, δ-heptalactone, δ-octalactone, δ-nonalactone, δ-decalactone, δ-undecalactone, ϵ-caprolactone, and mixtures thereof may be used.

The viscosity of the latex ink can be increased by evaporating the water and the solvent in the heating step (described later).

An inkjet ejecting apparatus may be used for the applying step in which the latex ink is applied onto a transfer medium to form an ink applied surface.

Figure 2:
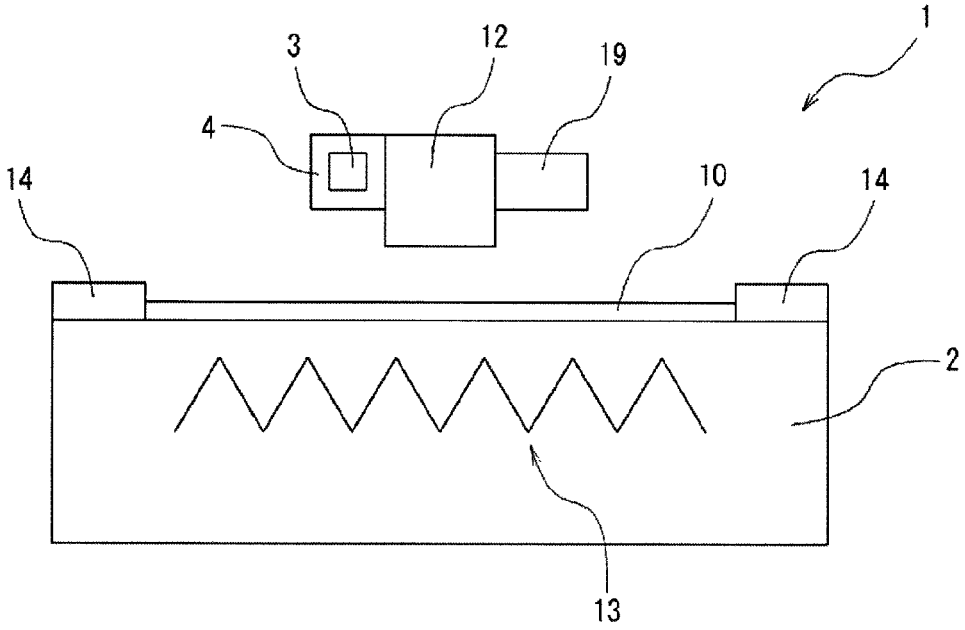
FIG. 2 is a side view (schematic diagram) of the inkjet ejecting apparatus of FIG. 1.

FIG. 1 represents a plan view (schematic diagram) of an inkjet ejecting apparatus 1 according to the present embodiment. FIG. 2 represents a side view (schematic diagram) of the inkjet ejecting apparatus 1.

The inkjet ejecting apparatus 1 includes a platen (support) 2 that supports a transfer medium (here, a transfer sheet) 10 receiving the latex ink, an inkjet head 12 that expels the ink in the form of ink droplets onto the surface of the transfer sheet 10 through a plurality of ejection openings while moving in X direction, and a controller (not illustrated) that controls the operation of each component.

The inkjet head 12 is structured to piezoelectrically expel ink droplets through nozzles (not illustrated) disposed side by side on its lower face. The inkjet head 12 is fixed to a unit trestle 4, and can travel along a guide rail 3 in X direction by being driven by traveling means (not illustrated). The traveling means is configured from an electric motor, an electronic circuit, and the like. Note, however, that the configuration of the traveling means is not limited to this.

The inkjet ejecting apparatus 1 also includes a heater as a heating means that heats the transfer sheet 10 to heat the inkjet droplets expelled onto the transfer sheet 10.

The heater is described below in detail. As illustrated in the figure, the heater includes an upper heater 19 that heats the landed ink droplets on the surface of the transfer sheet 10 from the front-surface side of the transfer sheet 10. This can cure the inkjet droplets (temporary cure, described later). As an example, the upper heater 19 may be realized by an infrared heater, a hot-air heater, and the like.

As illustrated in the figure, the heater includes a lower heater 13 that heats the landed ink droplets on the surface of the transfer sheet 10 from the back-surface side of the transfer sheet 10. This can cure the inkjet droplets (temporary cure, described later). As an example, the lower heater 13 may be realized by an electrical heater, an infrared heater, an induction heater (IH), and the like, and is disposed inside the platen 2 on the back-surface side of the transfer sheet 10.

The heater, described as including the upper heater 19 and the lower heater 13 in the present embodiment, may be configured to include either one of the upper heater 19 and the lower heater 13.

As an example of the operation of the inkjet ejecting apparatus 1, the platen 2 supports and fixes the transfer sheet 10 attached to a holder 14, and the inkjet head 13 travels end to end of the transfer sheet 10 in X direction while expelling inkjet droplets (latex ink).

Here, the controller controls the temperature of the heater to bring the latex ink on the transfer sheet 10 to the desired cure state (temporary cure state or permanent cure state, described later).

As described above, the inkjet ejecting apparatus 1 according to the present embodiment enables an ink applied surface to be formed on the transfer sheet 10 by expelling and printing the latex ink in the form of inkjet droplets. Specifically, the inkjet head 12 expels inkjet droplets (latex ink) onto the surface of the transfer sheet 10 supported on the platen (support) 2. The upper heater 19 and/or the lower heater 13 then heat the inkjet droplets (latex ink) landed on the surface of the transfer sheet 10 to bring the inkjet droplets to the desired cure state. The resulting transfer sheet 10 can thus have a surface (hereinafter, "ink applied surface") on which the ink has been applied in the desired transfer pattern. With the use of the inkjet ejecting apparatus 1, the ink applied surface can be formed at high speed, specifically, time can be saved for the applying step.

The latex ink may have a viscosity as may be decided according to the intended purpose, preferably a viscosity of 3 [mPa·sec] to 20 [mPa·sec] at 25 [° C.] in the applying step (the state before the heating step). The inkjet head 12 can easily eject the ink in this viscosity range.

In the heating step, the latex ink is heated to thicken by evaporating the water and the solvent contained in the latex ink. As an example, the water and solvent content with respect to the total latex ink amount in the present embodiment is 20 [weight %] to 95 [weight %] prior to heating. The latex ink is heated to thicken to the desired viscosity by evaporating the water and the solvent in the predetermined amount.

More specifically, the latex ink is heated to thicken preferably to a viscosity of 100 [mPa·sec] to 200,000 [mPa·sec] at 25 [° C.]. With this viscosity range, the latex ink can have a form of a liquid or a paste with a sufficiently high viscosity that does not cause bleeding, and that provides adhesion preferable for transfer.

The transfer medium (here, transfer sheet) 10 of the present embodiment is described below. Various materials may be used for the transfer sheet 10 according to the intended purpose. Preferably, the transfer sheet 10 is made of an elastic material to make the transfer easier when the printing target 15 has a non-flat surface such as a curved surface. More preferably, the material of the transfer sheet 10 is one that can deform along the shape of the printing surface of the printing target 15 upon contacting the printing target 15. Any such material may be used, as long as it has heat resistance, and is printable by inkjet printing.

More specifically, for example, a silicon rubber may preferably be used as the material of the transfer sheet 10. Other than silicon rubber, rubbers and elastomer resins such as fluoro rubber, butyl rubber, chloroprene rubber, urethane rubber, butadiene rubber, neoprene, and EPDM may be used either alone, or in combination as a composite material, as may be decided according to the intended purpose. By using these materials, the ink applied surface of the transfer sheet 10 can be transferred to the printing target 15 by being directly pressed against the printing target 15 in contact with the transfer sheet 10. This makes it easier to perform the transfer step.

When the transfer sheet 10 is disposable, the transfer sheet 10 may be made of a material that does not restore its shape, instead of using a material, such as rubber, that returns to the original shape when the applied pressure is removed. Examples of such non-restoring materials include thin resin films, such as soft urethane, polyester, and polyethylene, that can expand and contract at room temperature, or that can deform under heat because of thermoplasticity.

Note that the hardness and the thickness of the transfer sheet 10 may be appropriately varied according to the shape of the printing target 15. For example, the transfer sheet 10 preferably has lower hardnesses and thinner thicknesses as the shape of the printing target 15 becomes more complex. When the printing target 15 is a flat plate, the transfer sheet 10 may have a form of a rubber plate.

Printing Method According to First Embodiment

A printing method according to First Embodiment of the present invention is described below. FIGS. 3A to 3E are diagrams schematically representing the printing method according to the present embodiment.

Figure 3A:
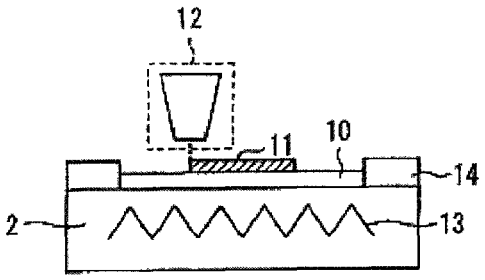
FIGS. 3A to 3E are explanatory diagrams explaining a printing method according to First Embodiment of the present invention.

The applying step is described first. As illustrated in FIG. 3A, the inkjet head 12 is used to apply the latex ink onto the transfer sheet 10 of a material such as silicon rubber on a flat plate. The latex ink applied onto the transfer sheet 10 forms an ink applied surface. Note that the transfer sheet 10 is attached to the holder 14 to maintain flatness, and improve operability.

The next step is the heating step, in which the heater is used to heat and dry the latex ink on the transfer sheet 10 by evaporating the water and the solvent. Here, the water and the solvent are evaporated to adjust viscosity to such an extent that the latex ink does not bleed, and maintains adhesion sufficient to enable transfer. As a result, a temporarily cured print image 11 is formed on the transfer sheet 10. Note that the term "temporary cure" (or "semi-dry") is used to refer to the state where the water and the solvent have evaporated to increase the viscosity of the latex ink, and the "permanent cure" (described later) has not occurred.

As described above, the heater used in the present embodiment may include the upper heater 19 and/or the lower heater 13 (only the heater 13 is shown in FIG. 3A). For example, the heating by the heater is preferably 30 [° C.] to 70 [° C.] for 5 [sec] to 5 [min], more preferably for 1 [min] or less.

From the standpoint of facilitating ejection through the inkjet head 12 in the applying step, the latex ink viscosity is set to preferably 3 [mPa·sec] to 20 [mPa·sec] at 25 [° C.] in the present embodiment. The latex ink is then thickened to, for example, 100 [mPa·sec] to 200,000 [mPa·sec] at 25 [° C.] by the heater in the heating step. With this viscosity range, the latex ink can have a form of a liquid or a paste with a sufficiently high viscosity that does not cause bleeding, and that provides adhesion preferable for transfer. The foregoing viscosity range may be attained by setting parameters such as the proportion of the pigment added, the size and the proportion of the latex particles added, the boiling point and the proportion of the solvent added, and the proportion of the water added.

In the present embodiment, the applying step and the heating step are performed preferably at the same time by applying the latex ink onto the transfer sheet 10 while heating the transfer sheet 10. In this way, because the transfer sheet 10 is heated, the ink is immediately heated upon landing, and thickens as the solvent and the water content evaporate. The ink can thus semi-dry (temporarily cure) before it has time to bleed. Further, because of the sufficiently increased viscosity, the thinning phenomenon due to the bleeding and the reduced thickness of the spread ink can be avoided in the next transfer step.

Figure 3B:
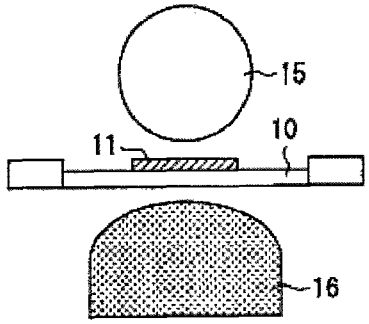

Thereafter, the transfer sheet 10 is moved between the printing target 15 and a pad 16 provided as a pressing member, as illustrated in FIG. 3B. Here, for convenience of explanation, the printing target 15 is shown as a simple sphere. However, the printing target 15 is not limited to this, and various shapes of printing target may be used for printing.

Figure 3C:
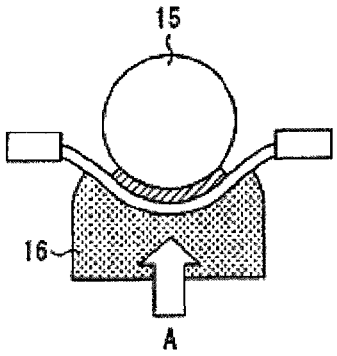

The next step is the transfer step. Specifically, as illustrated in FIG. 3C, the pad 16 is pressed in the direction of arrow A to bring the ink applied surface (surface with the temporarily cured print image 11) of the transfer sheet 10 into contact with the printing surface of the printing target 15. This transfers the temporarily cured print image 11 to the printing target 15.

Here, there is a viscosity gradient in the latex ink because the drying of the latex ink proceeds from the surface in the heating step performed before the transfer step. Specifically, the viscosity of the latex ink is higher on the side in contact with the transfer sheet 10 than on the ink applied surface side. Because of the viscosity gradient, the latex ink is desirably transferred to the transfer sheet.

Here, because the pressure of the transfer flattens the latex ink retaining some softness, a high glossy image can be obtained. If a matte look is desired, a matte surface may be provided for the transfer sheet 10.

The pad 16 is preferably made of an elastic material, more preferably a material that can evenly apply pressure to the target (transfer sheet 10, printing target 15). Examples of possible materials include a soft rubber, a hard rubber, a sponge, and a bag filled with liquid, powder, or gas. It is also possible to use materials such as metal, wood, and felt, as may be decided according to the shapes, the materials, and other properties of the transfer sheet 10 and the printing target 15.

The transfer step may be performed at room temperature. However, for more stable transfer, the transfer step may be performed under heat to provide a constant-temperature transfer environment. The latex ink can be stably transferred to the printing target 15 by contacting the latex ink (temporarily cured print image 11) on the transfer sheet 10 to the printing target 15 while heating the transfer sheet 10 in the transfer step, provided that the latex ink used has thermoplasticity in the temporarily cured state.

When the thermoplasticity of the latex ink itself is insufficient, at least 15 [weight %] of the resin component in the ink should preferably be a thermoplastic resin.

Figure 3D:
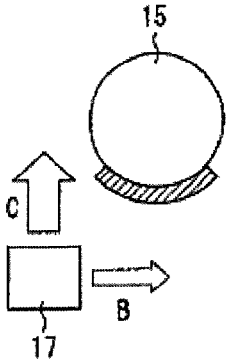

The next step is the drying step. Specifically, as illustrated in FIG. 3D, the heating means 17 is moved in the direction of arrow B as the heating means 17 applies heat to the temporarily cured print image 11 on the printing target 15 in the direction of arrow C. This dries and cures the whole latex ink (temporarily cured print image 11) transferred onto the printing target 15. The cure by the drying step will be referred to as "permanent cure" to distinguish it from the cure that increases viscosity in the heating step.

The heating means 17 may be realized by various means, including, for example, a ceramic heater, a tungsten heater, a sheathed wire heater, a far infrared heater, an IH heater, a hot-air heater, and combinations of these.

Figure 3E:
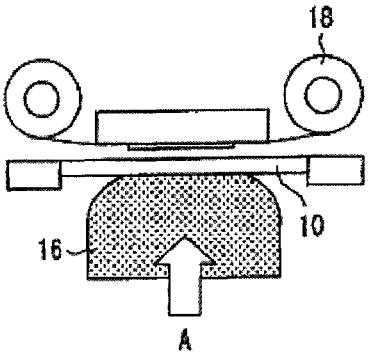

For any subsequent printing, a cleaning sheet 18 is used to clean the transfer sheet 10, as illustrated in FIG. 3E. For example, the cleaning sheet 18 is slid to wipe away any remaining ink, dust, and other materials from the transfer sheet 10 under the pressure of the pad 16 pressed in the direction of arrow A. The transfer sheet 10 and the pad 16 may be washed with the use of an alcohol or the like.

The printing method according to the present embodiment does not require fabrication of a printing plate, and can print on a variety of curved surfaces in small volumes, both quickly and at low cost. Further, because only a single transfer is required, less image misalignment and less bleeding occur in the transfer as compared to the conventional pad printing that requires two transfers involving the indirect transfer from the transfer sheet to the printing target. It is therefore possible to obtain a high-quality transfer image with simple steps. Another advantage is that the pad does not contact the latex ink, making it contamination-free, and reusable without any further process.

As a possible variation of the printing method according to the present embodiment, the latex ink (temporarily cured print image 11) on the transfer sheet 10 may be heated to permanently cure in the heating step.

In this case, the latex ink can be stably transferred to the printing target 15 by contacting the latex ink (temporarily cured print image 11) on the transfer sheet 10 to the printing target 15 while heating the transfer sheet 10 in the transfer step, provided that the latex ink used has thermoplasticity in the permanently cured state.

An advantage of this variation is that stable transfer performance can be obtained even when the latex ink (temporarily cured print image 11) on the transfer sheet 10 cannot be easily brought to the temporarily cured state in the heating step.

Printing Method According to Second Embodiment

A printing method according to Second Embodiment of the present invention is described below.

The printing method according to Second Embodiment shares the same basic configuration with the printing method of First Embodiment, but differs from First Embodiment in the transfer step. Accordingly, the present embodiment will be described by focusing on primarily these differences.

Figure 4A:
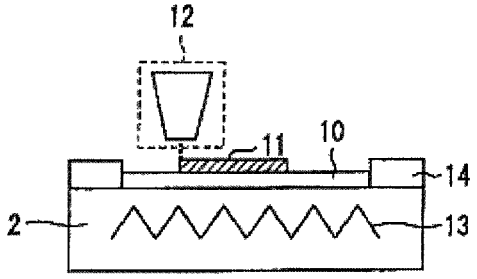
FIGS. 4A to 4E are explanatory diagrams explaining a printing method according to Second Embodiment of the present invention.

As illustrated in FIG. 4A, the printing method according to the present embodiment begins with the applying step in which the inkjet head 12 applies the latex ink onto the transfer sheet 10 fixed to maintain flatness with the holder 14.

The next step is the heating step, in which the heater heats the latex ink to dry on the transfer sheet 10 by evaporating the water and the solvent. As a result, the temporarily cured print image 11 is formed on the transfer sheet 10. The heater used may include the upper heater 19 and/or the lower heater 13 (only the heater 13 is shown in FIG. 4A).

Figure 4B:
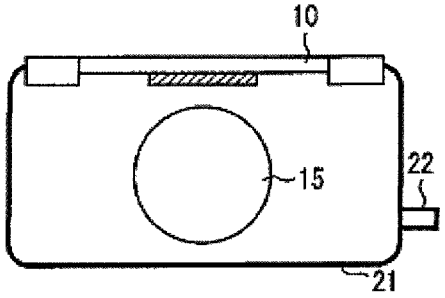

The transfer step characteristic of the present embodiment is described below. First, as illustrated in FIG. 4B, the printing target 15 is housed in a housing (here, airtight vacuum chamber) 21. The opening of the vacuum chamber 21 is then covered with the transfer sheet 10 oriented to place the temporarily cured print image 11 inside the vacuum chamber 21. Specifically, the holder 14 is set at the end of the opening. In other words, the transfer sheet 10 is installed as a portion of the outer wall of the vacuum chamber 21. This seals the vacuum chamber 21. The vacuum chamber 21 has an outlet 22.

Figure 4C:
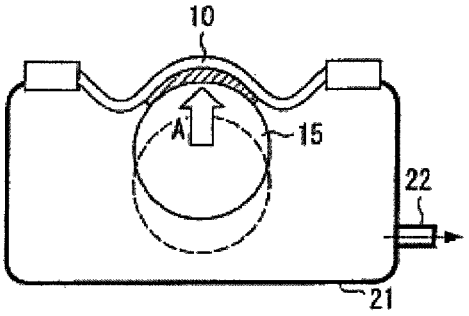

Thereafter, as illustrated in FIG. 4C, the air inside the vacuum chamber 21 is released through the outlet 22 to create a reduced pressure inside the vacuum chamber 21. The reduced pressure bends the transfer sheet 10 inward into the vacuum chamber 21. On the other hand, the printing target 15 moves in the direction of arrow A, and contacts the transfer sheet 10. Upon contact, the temporarily cured print image 11 is transferred to the printing target 15. As a possible alternative method, the printing target 15 may remain static by being fixed.

Here, it is preferable to heat the transfer rubber sheet 10 and the printing target 15 beforehand to make the transfer sheet 10 softer and more easily follow the shape of the printing target 15.

As a possible variation of the housing (vacuum chamber) 21 structure, the transfer sheet 10 may be installed on the inner side of a portion of the outer wall of the vacuum chamber 21, the outer wall portion of the vacuum chamber 21 being deformable or movable in response to inner volume changes, and the vacuum chamber 21 being capable of maintaining airtightness with the transfer sheet 10 installed therein (not illustrated). With this configuration, the outer wall portion deforms or moves inward into the vacuum chamber 21 upon releasing air through the outlet 22 and creating a reduced pressure in the vacuum chamber 21, and the transfer sheet 10 bends inward into the vacuum chamber 21. On the other hand, the printing target 15 moves in the direction of arrow A, and contacts the transfer sheet 10. Upon contact, the temporarily cured print image 11 is transferred to the printing target 15. As a possible alternative method, the printing target 15 may remain static by being fixed.

Figure 4D:
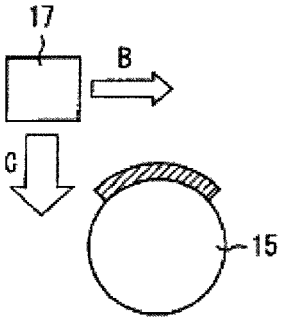

The next step is the drying step. Specifically, as illustrated in FIG. 4D, the heating means 17 is moved in the direction of arrow B as the heating means 17 applies heat to the temporarily cured print image 11 on the printing target 15 in the direction of arrow C. This dries and cures (permanent cure) the whole temporarily cured print image 11 on the printing target 15.

Figure 4E:
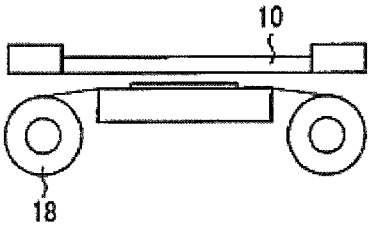

For any subsequent printing, a cleaning sheet 18 is used to clean the transfer sheet 10, as illustrated in FIG. 4E.

The printing method according to the present embodiment enables a direct transfer from the transfer sheet 10 to the printing target 15, without using the pad 16. Further, the method makes it easier to perform a transfer to a large-area printing target having large irregularities. This is made possible by the use of the atmospheric pressure, which makes it easier to more evenly apply pressure. Further, by adjusting the shape and the material of the transfer sheet 10, a transfer to substantially the whole peripheral surface of the printing target 15 is possible even when the printing target 15 has a three-dimensional shape such as a sphere.

Other advantages of the printing method according to the present embodiment are basically the same as those of the printing method of First Embodiment, and will not be described.

The variations described in First Embodiment are also applicable to Second Embodiment. Specifically, as a possible alternative method, the latex ink (temporarily cured print image 11) on the transfer sheet 10 may be heated to permanently cure in the heating step.

In this case, the latex ink can be stably transferred to the printing target 15 by contacting the latex ink (temporarily cured print image 11) on the transfer sheet 10 to the printing target 15 while heating the transfer sheet 10 in the transfer step, provided that the latex ink used has thermoplasticity in the permanently cured state.

An advantage of this variation is that stable transfer performance can be obtained even when the latex ink (temporarily cured print image 11) on the transfer sheet 10 cannot be easily brought to the temporarily cured state in the heating step.

As described above, with the printing method disclosed, a high-quality transfer image can be obtained with simpler steps as compared to conventional printing methods.

The present embodiment also has other characteristic advantages, as follows.

The printing method includes an applying step of applying the latex ink onto the transfer sheet 10 to form an ink applied surface, a heating step of heating the transfer sheet 10 to increase the viscosity of the latex ink, a transfer step of contacting and transferring the latex ink on the transfer sheet 10 to the printing target 15, and a drying step of drying the latex ink on the printing target 15. By using the latex ink, a transfer image can be formed on the transfer sheet 10 without forming an ink receptive layer on the transfer sheet 10. The transfer step thus requires only a single transfer from the transfer sheet 10 to the printing target 15, and can be simplified. Further, because the latex ink is used to form an image on the transfer sheet 10, there will be no variation in the extent of curing as might occur with a UV ink, and a high-quality transfer image can be formed that does not involve ink bleeding. Further, the transfer image can transfer from the transfer sheet 10 to the printing target 15 with the maintained desirable transfer performance in the semi-dry state.

Preferably, the latex ink has thermoplasticity in the state after the heating step, and the latex ink on the transfer sheet 10 contacts and transfers to the printing target 15 while the transfer sheet 10 is heated in the transfer step. By transferring the latex ink while heating the transfer sheet 10, specifically the latex ink on the transfer sheet 10, stable transfer performance can be obtained.

The applying step and the heating step are performed preferably at the same time by applying the latex ink onto the transfer sheet 10 while heating the transfer sheet 10. In this way, because the transfer sheet 10 is heated, the latex ink is immediately heated upon landing, and thickens as the solvent and the water content evaporate. The ink can thus semi-dry before the landed ink has time to bleed.

The latex ink has a viscosity of preferably 100 mPa·sec to 200,000 mPa·sec at 25° C. after being thickened in the heating step. By increasing the latex ink viscosity to this range, the latex ink does not bleed during the transfer, and a high-quality image can be obtained. Further, because the ink is semi-dried, desirable transfer performance can be obtained.

The transfer step is performed preferably as follows. The transfer sheet 10 disposed to face the ink applied surface toward the printing target 15 is pressed from the opposite side with the pad 16 to contact the ink applied surface to the printing target 15, and transfer the latex ink on the transfer sheet 10 onto the printing target 15. By pressing the transfer sheet 10 against the printing target 15 with the pad 16 from the opposite side of the latex ink applied surface of the transfer sheet 10, the transfer sheet 10 can deform along the printing target 15, and contact the printing target 15 to form a desirable transfer image even when the printing target 15 is three-dimensional.

The transfer step is performed preferably as follows. The transfer step uses the vacuum chamber 21 adaptable to install the transfer sheet 10 as a portion of its outer wall, or on the inner side of a portion of the outer wall of the vacuum chamber 21, the outer wall portion of the vacuum chamber 21 being deformable or movable in response to inner volume changes, and the vacuum chamber 21 being capable of maintaining airtightness with the transfer sheet 10 installed therein. After housing the printing target 15 inside the vacuum chamber 21, the transfer medium is installed as a portion of the outer wall of the housing, or on the inner side of a portion of the outer wall of the housing with the ink applied surface facing the printing target. The pressure inside the vacuum chamber 21 is then reduced to deform or move the outer wall portion inwardly into the vacuum chamber 21 in a manner that lowers the inner volume of the vacuum chamber 21, and to contact the ink applied surface of the transfer sheet 10 to the printing target 15, and transfer the latex ink on the transfer sheet 10 to the printing target 15. In this way, as with the case of applying pressure with the pad 16, the transfer sheet 10 can deform along the printing target 15, and contact the printing target 15 to transfer the image on the transfer sheet 10 to the printing target 15 even when the printing target 15 is three-dimensional. In contrast to the pad press that can transfer the ink to only some parts of the printing target 15, the evacuation of the vacuum chamber 21 enables a transfer to the whole part of the printing target 15.

The inkjet ejecting apparatus 1 is an inkjet ejecting apparatus for use in the foregoing printing method, and includes the inkjet head 12 that expels a latex ink onto the transfer sheet 10 in the form of an inkjet droplet, a heater that heats the transfer sheet 10, and a controller that controls the temperature of the heater. The inkjet printing by expulsion of the latex ink in the form of inkjet droplets makes it possible to form the ink applied surface at high speed; specifically, time can be saved for the applying step. Further, by controlling the heater temperature, the latex ink can be brought to the desired cure state (temporary cure state or permanent cure state).

The present invention is not limited to the descriptions of the embodiments above, but may be altered in many ways within the scope of the present invention.

The invention claimed is:

1. A printing method comprising:

an applying step of applying a latex ink including a solvent onto a transfer medium to form an ink applied surface;

a heating step of heating the transfer medium to increase a viscosity of the latex ink on the ink applied surface of the transfer medium by evaporating the solvent from the latex ink, wherein the applying step and the heating step are simultaneously performed by applying the latex ink onto ink applied surface of the transfer medium while a surface of the latex ink on the ink applied surface is heated via the transfer medium;

a transfer step of contacting and transferring the latex ink on the transfer medium to a printing target; and a drying step of drying the latex ink on the printing target.

2. The printing method according to claim 1, wherein the latex ink has thermoplasticity in the state after the heating step, and wherein the transfer step contacts and transfers the latex ink on the transfer medium to the printing target by deforming the latex ink along a shape of the printing target while heating the transfer medium.

3. The printing method according to claim 1, wherein the latex ink has a viscosity of 5000 mPa·sec to 200,000 mPa·sec at 25° C. after being thickened in the heating step.

4. The printing method according to claim 1, wherein, in the transfer step, the transfer medium disposed to face the ink applied surface toward the printing target is pressed with a pressing member from the opposite side from the ink applied surface to contact the ink applied surface to the printing target, and transfer the latex ink on the transfer medium to the printing target.

5. The printing method according to claim 1, wherein the transfer step uses a housing adaptable to install the transfer medium as a portion of its outer wall, or on the inner side of a portion of the housing outer wall, the outer wall portion of the housing being deformable or movable in response to inner volume changes, and the housing being capable of maintaining airtightness with the transfer medium installed therein, and wherein the transfer step includes:

housing the printing target inside the housing;

installing the transfer medium as a portion of the housing outer wall, or on the inner side of a portion of the housing outer wall with the ink applied surface facing the printing target; and reducing the pressure inside the housing to deform or move the outer wall portion inwardly into the housing in a manner that lowers the inner volume of the housing, and to contact the ink applied surface of the transfer medium to the printing target, and transfer the latex ink on the transfer medium to the printing target.

6. An inkjet ejecting apparatus the apparatus comprising:

an inkjet head that expels a latex ink including a solvent onto a transfer medium in a form of an inkjet droplet to form an ink applied surface;

a heater that heats the transfer medium, wherein the inkjet head expels the latex ink onto the ink applied surface of the transfer medium while the heater heats a surface of the latex ink on the ink applied surface via the transfer medium; and a controller that controls the temperature of the heater.

7. The inkjet ejecting apparatus of claim 6, wherein the heated latex ink has a viscosity of 5000 mPa·sec to 200,000 mPa·sec at 25° C.

8. The printing method according to claim 1, wherein the latex ink comprises an emulsion or suspension ink prepared by dispersing a thermoplastic resin in water and the solvent with color material.

9. The printing method according to claim 1, wherein the latex ink has a viscosity of 3 mPa·sec to 20 mPa·sec at 25° C. during the applying step.

10. The printing method according to claim 1, wherein the transfer medium is made of a material that deforms along a shape of a printing surface of the printing target upon contacting the printing target.

11. The printing method according to claim 1, wherein in the heating step, the latex ink is permanently cured.

12. The printing method according to claim 1, wherein the transfer step is performed while both the transfer medium and the printing target are heated.

13. The inkjet ejecting apparatus according to claim 6, wherein the heater heats the transfer medium to permanently cure the latex ink before transferring the cured latex ink to a printing target.

14. The inkjet ejecting apparatus according to claim 6, wherein the heater heats both of the transfer medium and a printing target while the latex ink on the transfer medium is transferred to the printing target.

15. The printing method according to claim 1, wherein the heating step comprises a step of directly a surface of the transfer medium which is opposite to the ink applied surface, while the latex ink is not directly heated.

16. The inkjet ejecting apparatus according to claim 6, wherein the heater directly heats a surface of the transfer medium which is opposite to the ink applied surface, while not directly heating the latex ink.

17. A printing method comprising:

an applying step of applying a latex ink onto a transfer medium to form an ink applied surface;

a heating step of heating the transfer medium to increase a viscosity of the latex ink;

a transfer step of transferring the latex ink on the transfer medium to a printing target by contacting on the printing target the latex ink having the viscosity which is higher on a side of the latex ink in contact with the printing target than on a side of the latex ink placed on the ink applied surface of the transfer medium; and a drying step of drying the latex ink on the printing target.

* * * * *